US008371373B2

(12) United States Patent
Ba-abbad

(10) Patent No.: US 8,371,373 B2
(45) Date of Patent: Feb. 12, 2013

(54) METHOD AND APPARATUS FOR PLUGGING LEAKING OIL AND GAS WELLS

(75) Inventor: Mazen A. Ba-abbad, Riyadh (SA)

(73) Assignee: King Abdul Aziz City for Science and Technology (KACST), Riyadh (SA)

( * ) Notice: Subject to any disclaimer, the term of this patent is extended or adjusted under 35 U.S.C. 154(b) by 251 days.

(21) Appl. No.: 12/870,762

(22) Filed: Aug. 27, 2010

(65) Prior Publication Data

US 2012/0048532 A1 Mar. 1, 2012

(51) Int. Cl.
*E21B 33/02* (2006.01)

(52) U.S. Cl. ..... 166/96.1; 166/75.13

(58) Field of Classification Search ..... 166/96.1, 166/75.13, 95.1
See application file for complete search history.

(56) References Cited

U.S. PATENT DOCUMENTS 2,238,742 A * 4/1941 Laurent ..... 403/3
2,532,341 A * 12/1950 Shannon ..... 166/96.1
3,379,253 A * 4/1968 Chism ..... 166/295
5,119,887 A * 6/1992 Rosa ..... 166/75.13
8,016,030 B1 * 9/2011 Prado Garcia ..... 166/75.13

* cited by examiner

*Primary Examiner* — William P Neuder
(74) *Attorney, Agent, or Firm* — Timberline Patent Law Group PLLC; Mark Farrell

(57) ABSTRACT

A method and apparatus for plugging leaking oil and leaking gas wells is disclosed. The apparatus includes a stepped structure capable of being mounted over the one of the leaking oil well and the leaking gas well. The stepped structure includes a plurality of structural modules arranged in a stacked form. A pipe arrangement capable of extracting one or effluents perpendicularly passes through the plurality of structural modules. One or more effluents are extracted from one of the leaking oil well and the leaking gas well. Additionally, one or more pressure relief pipes are provided to extract the one or more effluents. The one or more pressure relief pipes protrude outwardly through a peripheral surface of each of one or more structural modules. The pipe arrangement and the one or more pressure relief pipes enables extraction of the one or more effluents to reduce the pressure within the stepped structure.

16 Claims, 8 Drawing Sheets

METHOD AND APPARATUS FOR PLUGGING LEAKING OIL AND GAS WELLS

FIELD OF THE INVENTION

The present invention generally relates to plugging leaking oil and gas wells. More specifically, the present invention relates to a method and apparatus for plugging leaking oil and gas wells.

BACKGROUND OF THE INVENTION

Leakages due to failure of oil and gas well heads are common these days. Such leakages pose environmental and geological hazards and are required to be plugged within a short period of time. In the case where a leakage occurs in a subsea oil well, the damage caused by the leakage is magnified due to slick formation on surface of the sea. Leakages are plugged by placing plugs on the oil well heads and using relief pipes for transporting oil away from the oil well heads.

However, due to pressure at which oil emerges out from the leaking oil well heads, the plugs are inefficient at stopping flow of oil from the failed oil well head. Further, the plugs are a temporary solution for stopping the flow of oil until a normal oil extracting apparatus is installed in the oil well head.

Therefore, there is a need for an efficient method and apparatus for plugging leaking oil and gas wells.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
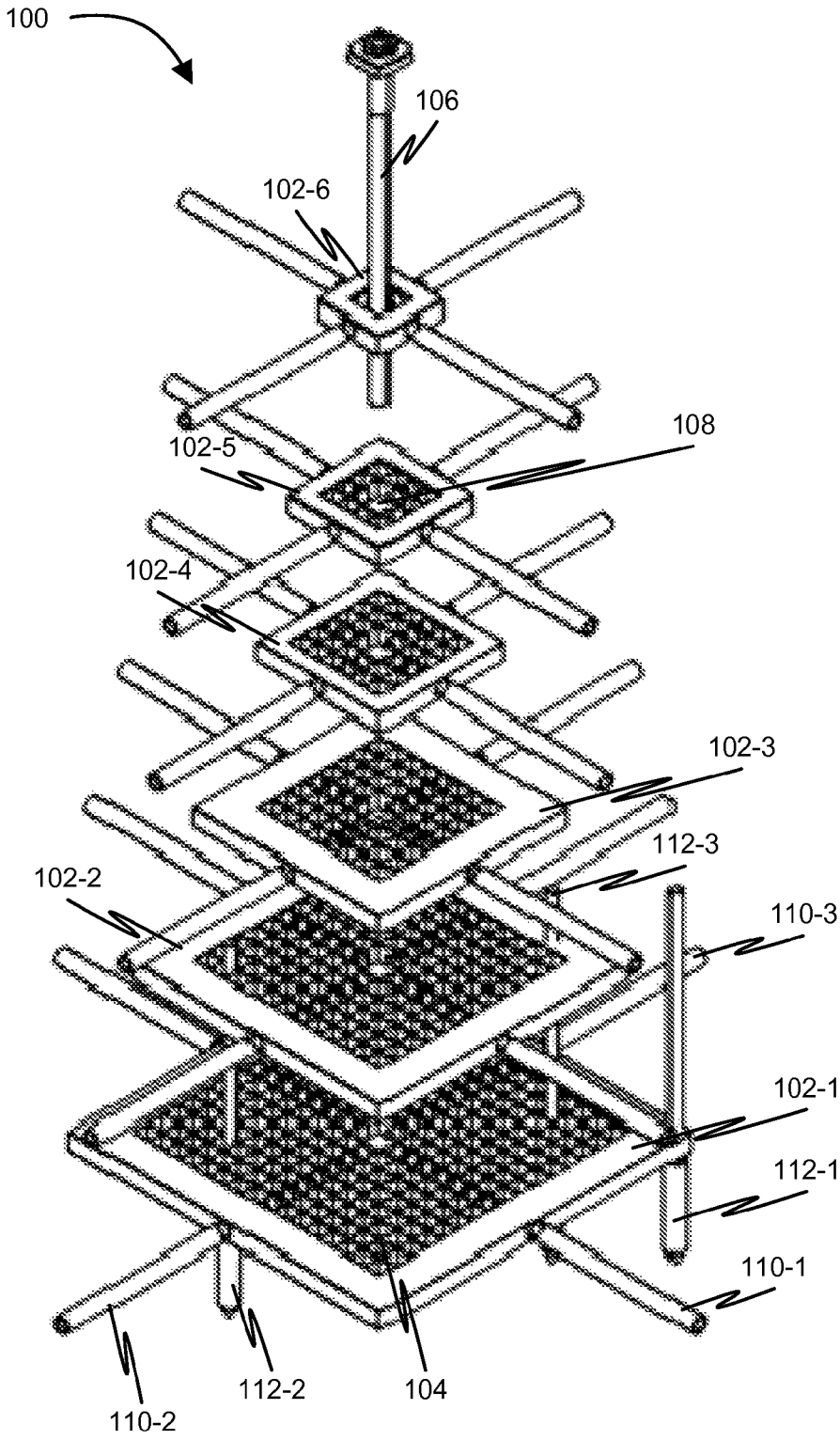
FIG. 1 illustrates an exploded view of an apparatus for plugging one of a leaking oil well and a leaking gas well in accordance with an embodiment.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE INVENTION

Before describing in detail embodiments that are in accordance with the invention, it should be observed that the embodiments reside primarily in combinations of method steps and apparatus components related to method and apparatus for plugging leaking oil wells. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions.

Various embodiments of the invention provide an apparatus for plugging one of a leaking oil well and a leaking gas well and a method for constructing thereof. Examples of the leaking oil well include but are not limited to one of a submerged oil well and an onshore oil well. The apparatus includes a stepped structure capable of being mounted over the one of the leaking oil well and the leaking gas well. The stepped structure includes a plurality of structural modules arranged in a stacked form. A pipe arrangement is configured to perpendicularly pass through the plurality of structural modules. One or more effluents are extracted from one of the leaking oil well and the leaking gas well using the pipe arrangement. Additionally, one or more pressure relief pipes are provided to further extract the one or more effluents. The one or more pressure relief pipes protrude outwardly through a peripheral surface of each of one or more structural modules. Thus, the pipe arrangement along with the one or more pressure relief pipes enables extraction of the one or more effluents thereby resulting in reduction of pressure within the stepped structure.

FIG. 1 illustrates an exploded view of an apparatus 100 for plugging one of a leaking oil well and a leaking gas well in accordance with an embodiment. Apparatus 100 enables extraction of one or more effluents from one of the leaking oil well and the leaking gas well. The one or more effluents may include but are not limited to, one or more of crude petroleum, slurry, and one or more hydrocarbon gases. The leaking oil well and the leaking gas well may be one of a leaking subsea oil well and a leaking subsea gas well. Apparatus 100 includes a stepped structure capable of being mounted over one of the leaking oil well and the leaking gas well. The stepped structure includes a plurality of structural modules **102-*n* arranged in a stacked form. Plurality of structural modules 102-*n* includes, but are not limited to a structural module 102-1, a structural module 102-2, a structural module 102-3, a structural module 102-4, a structural module 102-5 and a structural module 102-6**.

For example, structural module 102-2 may be stacked on top of structural module 102-1. Similarly, structural module 102-3 may be stacked on top of structural module 102-2 and structural module 102-4 may be stacked on top of structural module 102-3. Further, structural module 102-5 and structural module 102-6 may be stacked on top of structural module 102-4 and structural module 102-5 respectively.

In an embodiment, plurality of structural modules 102-*n* are attached to each other using an adhesive. Examples of the adhesive may include, but are not limited to resin, cement, and concrete. In an embodiment, the adhesive may be supplied into the stepped structure through one or more perforations (not shown in FIG. 1) provided on a peripheral surface of each structural module of plurality of structural modules 102-*n*.

Alternatively, plurality of structural modules 102-*n* are removably attached to each other using one or more fasteners. Examples of a fastener may include but are not limited to a rivet, a bolt, a clamp and a screw. The one or more fasteners enable plurality of structural modules 102-*n* to be removably attached to each other. Further, it will be apparent to a person skilled in the art that plurality of structural modules 102-*n* may be attached to each other using any other techniques known in the art.

In an embodiment, each structural module of plurality of structural module 102-*n* may have a smaller perimeter than a structural module below that structural module. For example, structural module 102-2 may have smaller perimeter than structural module 102-1. Thus, when plurality of structural modules 102-*n* are arranged in stacked form a pyramidal stepped structure is achieved.

The stepped structure including plurality of structural modules 102-*n* need to be mounted on one of the leaking oil well and the leaking gas well. In an embodiment, each structural module of plurality of structural module 102-*n* includes a plurality of bricks 104. Plurality of bricks 104 are composed of one of metal, cement, and mortar. Accordingly, weight of plurality of bricks 104 present in each structural module of plurality of structural modules facilitates in mounting the stepped structure in a stable manner on one of the leaking oil well and the leaking gas well. A process of arranging a plurality of bricks to form each structural module is explained in detail in conjunction with FIG. 2.

Plurality of structural modules 102-*n* efficiently retains the one or more effluents from one of the leaking oil well and the leaking gas well within the stepped structure. The one or more effluents may be flowing from an opening of one of the leaking oil well and the leaking gas well at a relatively high pressure. As plurality of structural modules 102-*n* form the pyramidal stepped structure, the pyramidal stepped structure may facilitate in the gradual reduction of pressure associated with the one or more effluents. More specifically, a reduction in perimeter associated with each structural module of plurality of structural modules 102-*n* enables in reducing the pressure associated with the one or more effluents.

The one or more effluents are extracted from the leaking oil well and the leaking gas well using a pipe arrangement 106. Pipe arrangement 106 is configured to perpendicularly pass through plurality of structural modules 102-*n*. More specifically, each structural module may include an opening and pipe arrangement 106 passes through the opening of each structural module to connect to one of the leaking oil well and the leaking gas well. For example, structural module 102-5 includes an opening 108 for receiving pipe arrangement 106 as illustrated in FIG. 1. An opening such as, opening 108 may be located at the center of each structural module.

Pipe arrangement 106 is connected to an opening of one of the leaking oil well and the leaking gas well. In an embodiment, a first end portion (not shown in FIG. 1) of pipe arrangement 106 is positioned within the opening of one of the leaking oil well and the leaking gas well to extract the one or more effluents. Pipe arrangement 106 is further explained in conjunction with FIG. 4.

Even though the one or more effluents are extracted by pipe arrangement 105, the one or more effluents may over flow and seep into the stepped structure. To extract these overflowing one or more effluents, one or more pressure relief pipes 110-*n* are provided in apparatus 100. One or more pressure relief pipes 104-*n* may include, but are not limited to a pressure relief pipe 110-1, a pressure relief pipe 110-2, and a pressure relief pipe 110-3. One or more pressure relief pipes 110-*n* protrude outwardly through a peripheral surface of each structural module of the plurality of structural modules 102-*n*. One or more pressure relief pipes 110-*n* is explained further in conjunction with FIG. 2 and FIG. 3. The one or more effluents are extracted by one or more pressure relief pipes 104-*n* to reduce the pressure within the stepped structure. For example, pressure relief pipe 110-1 protrudes outwardly through a hole present in a peripheral surface of structural module 102-1. The one or more effluents retained within the stepped structure are extracted by pressure relief pipe 110-1. Extraction of the one or more effluents by one or more pressure relief pipes is explained further in conjunction with FIG. 2 and FIG. 3.

To efficiently retain the one or more effluents, apparatus 100 needs to be firmly mounted on one of the leaking oil well and the leaking gas well. Accordingly, in an embodiment, apparatus 100 includes one or more gripping members 112-*n*. One or more gripping members 112-*n* are coupled to one or more structural modules of plurality of structural modules 102-*n*. One or more gripping members 112-*n* include, but are not limited to a gripping member 112-1, a gripping member 112-2, and a gripping member 112-3. For example, gripping member 112-1, gripping member 112-2, and gripping member 112-3 may pass through structural module 102-1. Structural module 102-1 may include holes (not shown in FIG. 1) for enabling gripping member 112-1, gripping member 112-2 and gripping member 112-3 to pass through structural module 102-1. In an embodiment, one or more gripping members 112-*n* may be fixedly coupled to the one or more structural modules. Alternatively, the one or more gripping members 112-*n* may be removably coupled to the one or more structural modules. In an alternate embodiment, a gripping member may be coupled to one or more structural modules of plurality of structural module 102-*n*. For example, gripping member 112-2 may pass through structural module 102-1 and structural module 102-2.

Explaining by way of an example, a subsea oil well in a sea bed may be leaking and thus may need to be plugged to prevent leakage of oil and one or more effluents. Accordingly, the stepped structure having one or more gripping members 112-*n* may be mounted on the leaking subsea oil well over the sea bed. The stepped structure may be mounted on the leaking subsea oil well using any techniques known in the art. While mounting the stepped structure, one or more gripping members 112-*n* sink into the sea bed thereby enabling the stepped structure to be firmly positioned on the leaking subsea oil well. To enable one or more gripping members 112-*n* to sink into the sea bed, force may be applied on the stepped structure using the techniques known in the art. In addition, weight of each structural module of the stepped structure enables the stepped structure to securely position on the sea bed.

In an embodiment, one or more gripping members 112-*n* may be positioned around the leaking subsea oil well is such a way that one or more gripping members 112-*n* sink into the sea bed. Thereafter, the stepped structure may be lowered to the seabed to couple with one or more gripping members 112-*n* using the techniques known in the art. More specifically, one or more gripping members 112-*n* may pass through holes present in one or more structural modules of the stepped structure thereby coupling the stepped structure to one or more gripping members 112-*n*.

Figure 2:
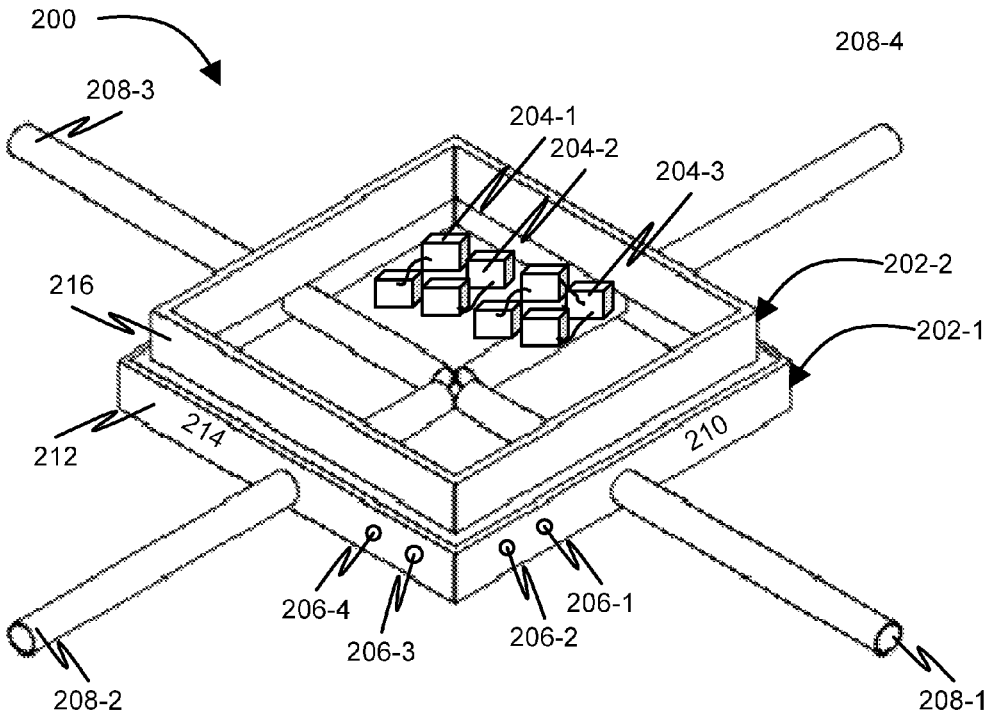
FIG. 2 illustrates a perspective view of a cross-section of an apparatus for plugging one of a leaking oil well and a leaking gas well in accordance with an embodiment.

FIG. 2 illustrates a perspective view of one or more structural modules of an apparatus for plugging one of a leaking oil well and a leaking gas well in accordance with an embodiment. The one or more structural modules such as, a structural module 202-1 and a structural module 202-2 may have a shape that is one of but not limited to a triangular shape, a circular shape, and a polygonal shape. Plurality of structural modules 202-*n* are arranged in a stacked form to create a stepped structure as described in conjunction with FIG. 1. In an embodiment, each structural module in the stepped structure may have a smaller perimeter than a structural module below that structural module. For example, structural module 202-2 may have smaller perimeter than structural module 202-1. Further, structural module 202-1 may be attached to structural module 202-2 using an adhesive. Alternatively, structural module 202-1 may be removably coupled to structural module 202-2 using one or more fasteners. This is explained in detail in conjunction with FIG. 1.

In an embodiment, each structural module of plurality of structural module 202-*n* includes a plurality of bricks 204-*n*. Plurality of bricks 204-*n* includes, but are not limited to a brick 204-1, a brick 204-2, and a brick 204-3. Plurality of bricks 204-*n* may be arranged in a layered fashion to form each structural module of the plurality of structural modules 202-*n*. In an embodiment, structural module 202-1 may include a layer of bricks. Alternatively, structural module 202-1 may include a plurality of layers of bricks. In this case, a layer of bricks may be arranged on top of another layer of bricks.

While forming each structural module, in an embodiment, plurality of bricks 204-*n* are connected to each other using one or more tapes. A tape of the one or more tapes may be for example, but not limited to a cotton tape. For example, one or more tapes may be wounded around a layer of bricks to closely position each brick to another brick in the layer of bricks.

In another embodiment, plurality of bricks 204-*n* may be connected to each other using one or more cables. The one or more cables may be composed of one or more of a metal, and an alloy such as, steel. For example, the one or more cables may pass through each bricks of plurality of bricks 204-*n* to connect each brick with another brick. Alternatively, the one or more cables may be wound around a layer of bricks to closely position each brick to another brick in the layer of bricks.

In yet another embodiment, an adhesive is used to attach plurality of bricks 204-*n*. Examples of the adhesive may include, but are not limited to resin, cement, and concrete. For example, an adhesive may be applied on a surface of a brick of a layer of bricks in structural module 202-1. Thereafter, the brick may be attached to another brick in the layer of bricks while arranging the bricks to form the layer of bricks. In an embodiment, the adhesive may be received within structural module 202-1 through one or more perforations 206-*n* such as, a perforation 206-1, a perforation 206-2, a perforation 206-3 and a perforation 206-4. The adhesive may be passed through one or more perforations 206-*n* using any adhesive injection techniques known in the art. The adhesive received through one or more perforations 206-*n* seep through plurality of bricks 204-*n* to attach each brick with another brick. The adhesive may be utilized to firmly attach plurality of structural modules 202-*n* to each other while arranged in a stacked form.

Plurality of bricks 204-*n* are arranged in a fashion blocking one or more effluents retained in the stepped structure from passing through one or more perforations 206-*n*. The one or more effluents pass through voids between one or more bricks of plurality of bricks 204-*n* so that these effluents is retained within one or more structural modules. The one or more effluents are extracted from the one or more structural modules using one or more pressure relief pipes 208-*n*. One or more pressure relief pipes 208-*n* includes, but are not limited to a pressure relief pipe 208-1, a pressure relief pipe 208-2, a pressure relief pipe 208-3 and a pressure relief pipe 208-4. In an embodiment, one or more pressure relief pipes 208-*n* are composed of one or more of a polymer, a metal, and an alloy of one or more metals. One or more pressure relief pipes protrude outwardly through a peripheral surface of structural module 202-1. More specifically, the peripheral surface of structural module 202-1 may include one or more holes to enable the one or more pressure relief pipes to pass through the peripheral surface. For example, a peripheral surface 210 of structural module 202-1 may include a hole (not shown in FIG. 2) to enable pressure relief pipe 208-1 to pass through the hole and protrude outwardly from peripheral surface 210. As illustrated in FIG. 2, a portion of pressure relief pipe 208-1 may be positioned within structural module 202-1 and a remaining portion of pressure relief pipe 208-1 may protrude out through peripheral surface 210.

In an embodiment, a structural module 202-1 may include a frame 212 having one or more holes. More specifically, each peripheral surfaces i.e. four vertical peripheral sides as shown in FIG. 2 of structural module 202-1 may include a hole (not shown in FIG. 2). For example, peripheral surface 210 of frame 212 may include a hole. A pressure relief pipe such as, pressure relief pipe 206-1 protrudes outwardly through the hole. Similarly, one or more pressure relief pipes may protrude outwardly through the other peripheral surfaces of frame 212. A frame such as, frame 212 is composed of one of metal and concrete. Frame 212 of structural module 202-1 is then filled with a first set of bricks. The first set of bricks is attached to each other using the adhesive as described earlier. In an embodiment, the first set of bricks may include one or more layers of bricks.

A frame such as, frame 212 may include one or more perforations 206-*n* for receiving the adhesive. For example, peripheral surface 210 of frame 212 includes a perforation 206-1 and a perforation 206-2. Further, a peripheral surface 214 of frame 212 includes a perforation 206-3 and a perforation 206-4. The adhesive passed through one or more perforations 206-*n* seeps through voids in the first set of bricks. Thus, the adhesive fixedly attaches a brick to another brick in the first set of bricks. Further, the adhesive may also attach the bricks of the first set of bricks with frame 212. This is explained in detail in conjunction with FIG. 1.

Similarly, a structural module 202-2 may include a frame 216 with one or more holes (not shown in FIG. 2). Thereafter, one or more pressure pipes may pass through the one or more holes of frame 214 of structural module 202-2. Thereafter, a second set of bricks are arranged within frame 214. An adhesive is thereafter received through one or more perforations (not shown in FIG. 2) in frame 214 to attach the second set of bricks. The adhesive seeps through the voids present within the second set of bricks to attach each brick of the second set of bricks to another brick. The adhesive also attaches bricks of the second set of bricks to frame 214 to form structural module 202-2.

Figure 3:
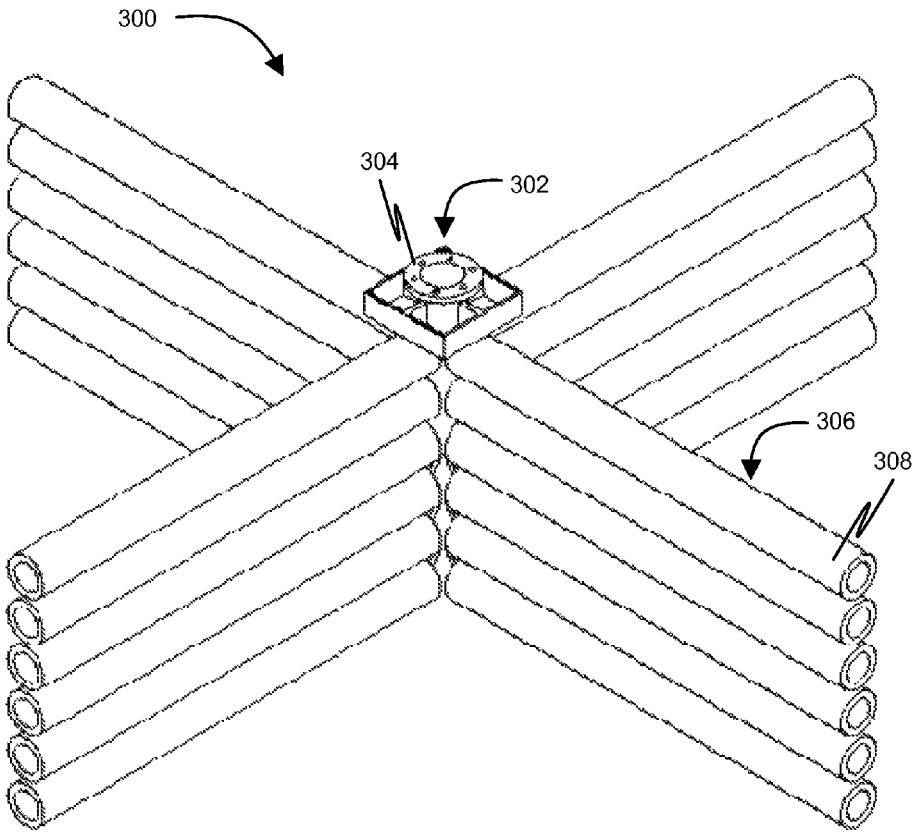
FIG. 3 illustrates an arrangement of a pipe arrangement and one or more pressure relief pipes provided for extracting one or more effluents from one of a leaking oil well and a leaking gas well in accordance with an embodiment of the invention.

FIG. 3 illustrates an arrangement 300 of a pipe arrangement and one or more pressure relief pipes provided for extracting one or more effluents from one of a leaking oil well and a leaking gas well in accordance with an embodiment of the invention. FIG. 3 is shown without the plurality of structural modules for purpose of illustration and to clearly indicate arrangement of the one or more pressure relief pipes with respect to the pipe arrangement. Arrangement 300 includes a pipe arrangement 302 for extracting the one or more effluents received from an opening of one of the leaking oil well and the leaking gas well. In an embodiment, pipe arrangement 302 is mounted over the opening of one of the leaking oil well and the leaking gas well. In another embodiment, a first end portion of pipe arrangement 302 is positioned within the opening of one of the leaking oil well and the leaking gas well to extract the one or more effluents.

In an embodiment, a flange 304 is removably connected to pipe arrangement 302. Flange 304 enables an external pump to be connected to an apparatus for pumping out the one or more effluents received from the leaking oil well and the leaking gas well. Pipe arrangement such as, pipe arrangement 302, is further explained in conjunction with FIG. 4. In addition to pipe arrangement 302, one or more pressure relief pipes, such as pressure relief pipe 306 are provided for extracting the one or more effluents retained within one or more structural modules. As described in conjunction with FIG. 1 and FIG. 2, the one or more effluents that overflow are retained within the voids between a plurality of bricks in the one or more structural modules. In an embodiment, the one or more pressure relief pipes are arranged in a direction perpendicular to pipe arrangement 302 as illustrated in FIG. 2. Alternatively, the one or more pressure relief pipes may be arranged at an angle with respect to pipe arrangement 302.

In an embodiment, one or more flanges (not shown in FIG. 3) may be removably connected to the one or more pressure relief pipes. For example, a flange (not shown in FIG. 3) may be connected to an end 308 of a pressure relief pipe 306. Then the one or more effluents extracted by pressure relief pipe 306 may be transported away using an external pipe connected to the flange. This prevents environmental hazards that are caused due to the one or more effluents. Further, as the one or more effluents are extracted by one or more pressure relief pipes and pipe arrangement 302, pressure within the stepped structure is also reduced.

Figure 4:
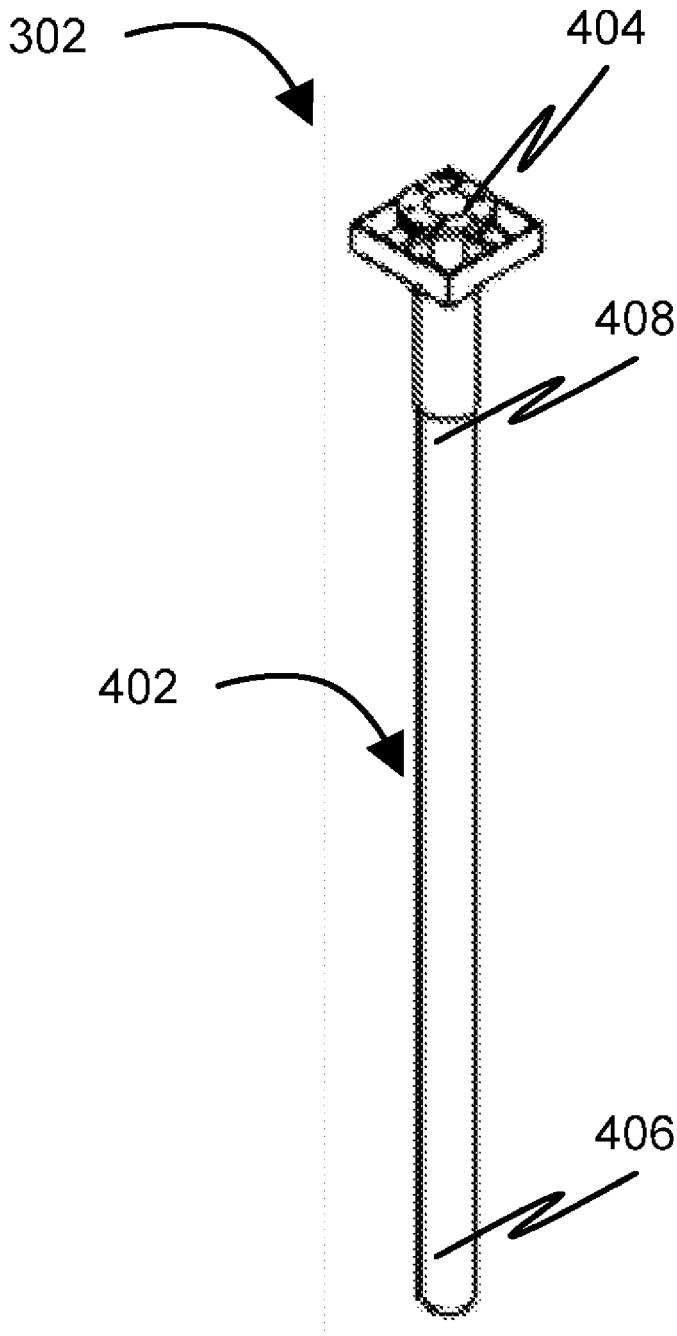
FIG. 4 illustrates a perspective view of the pipe arrangement in accordance with an embodiment.

FIG. 4 illustrates a perspective view of pipe arrangement 302 in accordance with an embodiment. As described earlier, pipe arrangement 302 is used to extract the one or more effluents from the leaking oil well and the leaking gas well. Pipe arrangement 302 is configured to perpendicularly pass through a plurality of structural modules (not shown in FIG. 4) arranged in a stacked form. In an embodiment, pipe arrangement 302 includes a repair insert pipe 402 and a flange 404. Repair insert pipe 402 may be connected to an opening of one of the leaking oil well and the leaking gas well. For example, a first end portion 406 of repair insert pipe 402 is positioned within the opening of one of the leaking oil well and the leaking gas well. In an embodiment, one or more sealing members (not shown in FIG. 4) are provided on a peripheral surface of first end portion 406. The one or more sealing members may act as a plug to prevent leakage of the one or more effluents that pass through repair insert pipe 402. Examples of a sealing member include, but are not limited to a bush and a threaded arrangement. The one or more sealing members may also enable in securely positioning repair insert pipe 402 to the opening. However, the one or more effluents may leak through repair insert pipe 402 into the stepped structure due to failure of the one or more sealing members and due pressure of the one or more effluents. The one or more effluents that are retained within the stepped structure are removed by the one or more pressure relief pipes as described in conjunction FIG. 1 and FIG. 2.

Now referring to flange 404, flange 404 may be connected to a second end portion 408 of repair insert pipe 402. In an embodiment, repair insert pipe 402 may include a thread (not shown in FIG. 4) wounded around second end portion 408 to connect with flange 404. The thread may be composed of a rubber material. However, it will be apparent to a person skilled in the art that the thread may be composed of any other material.

An external pump arrangement (not shown in FIG. 4) may be used for extracting the one or more effluents flowing through pipe arrangement 302. Accordingly, in an embodiment, the external pump arrangement is coupled to repair insert pipe 402 using flange 404. Flange 404 is further explained in conjunction with FIG. 5.

Figure 5:
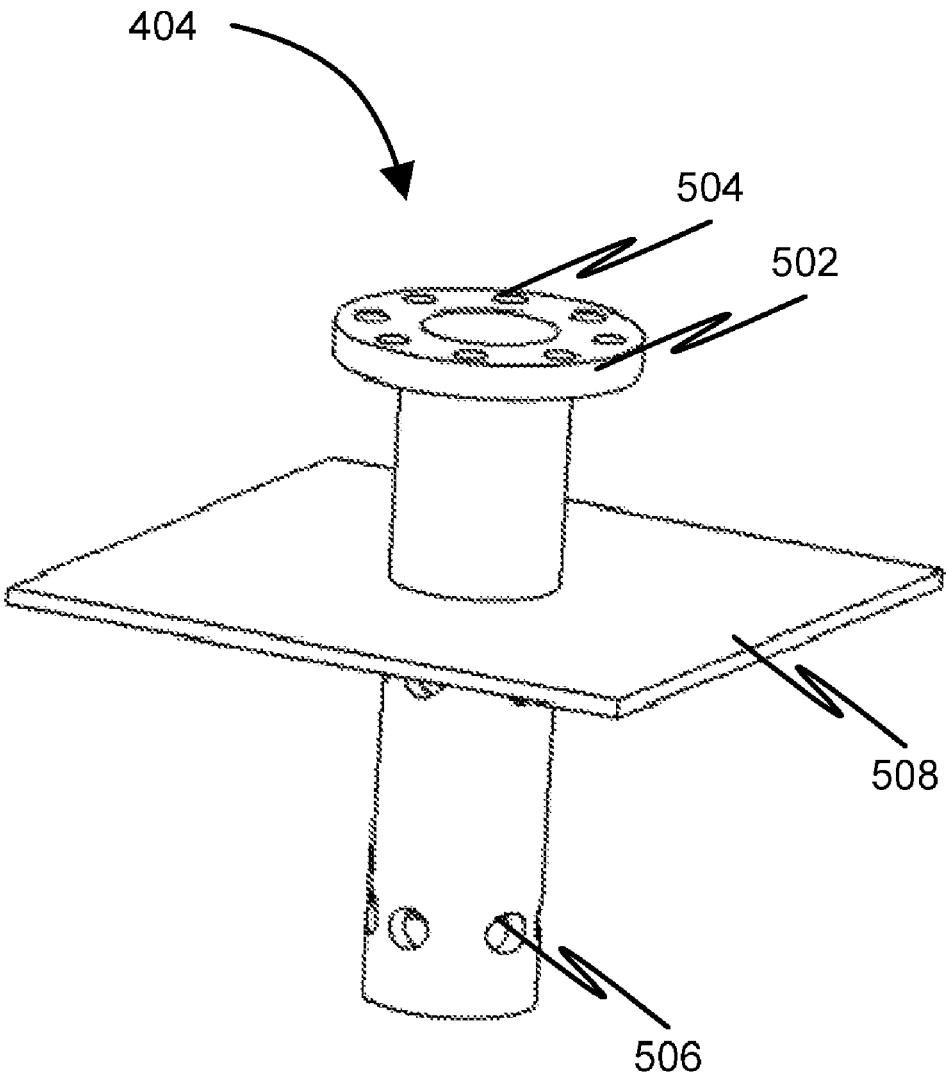
FIG. 5 illustrates a perspective view of a flange for coupling an external pump arrangement with a repair insert pipe in accordance with an embodiment.

FIG. 5 illustrates a perspective view of flange 404 for coupling an external pump arrangement with a repair insert pipe in accordance with an embodiment. Flange 406 includes a coupling member 502 for firmly coupling the external pump with the repair insert pipe. In an embodiment, coupling member 502 includes one or more holes such as, a hole 504 for receiving one or more fasteners. The one or more fasteners are used to removably couple an external pump arrangement with the repair insert pipe. Alternatively, the external pump arrangement may be fixedly coupled to the repair insert pipe. In an embodiment, flange 404 may include one or more perforations such as, a perforation 506 on a portion 508 of flange 404. The one or more perforations may facilitate in receiving one or more effluents from the repair insert pipe. In this case, portion 508 of flange 404 may be positioned within second end portion 408 of repair insert pipe 402.

Further, in an embodiment, a covering member 508 is provided for enabling flange 406 to cover an opening of a stepped structure that receives the pipe arrangement. For example, each structural module of the stepped structure may include an opening as explained in conjunction with FIG. 1. Pipe arrangement 302 is configured to pass through the opening of each structural module to connect to one of the leaking oil well and the leaking gas well as described in conjunction with FIG. 1. Thus, covering member 508 may be used to cover an opening of a top structural module such as, structural module 102-6 of apparatus 100.

Figure 6:
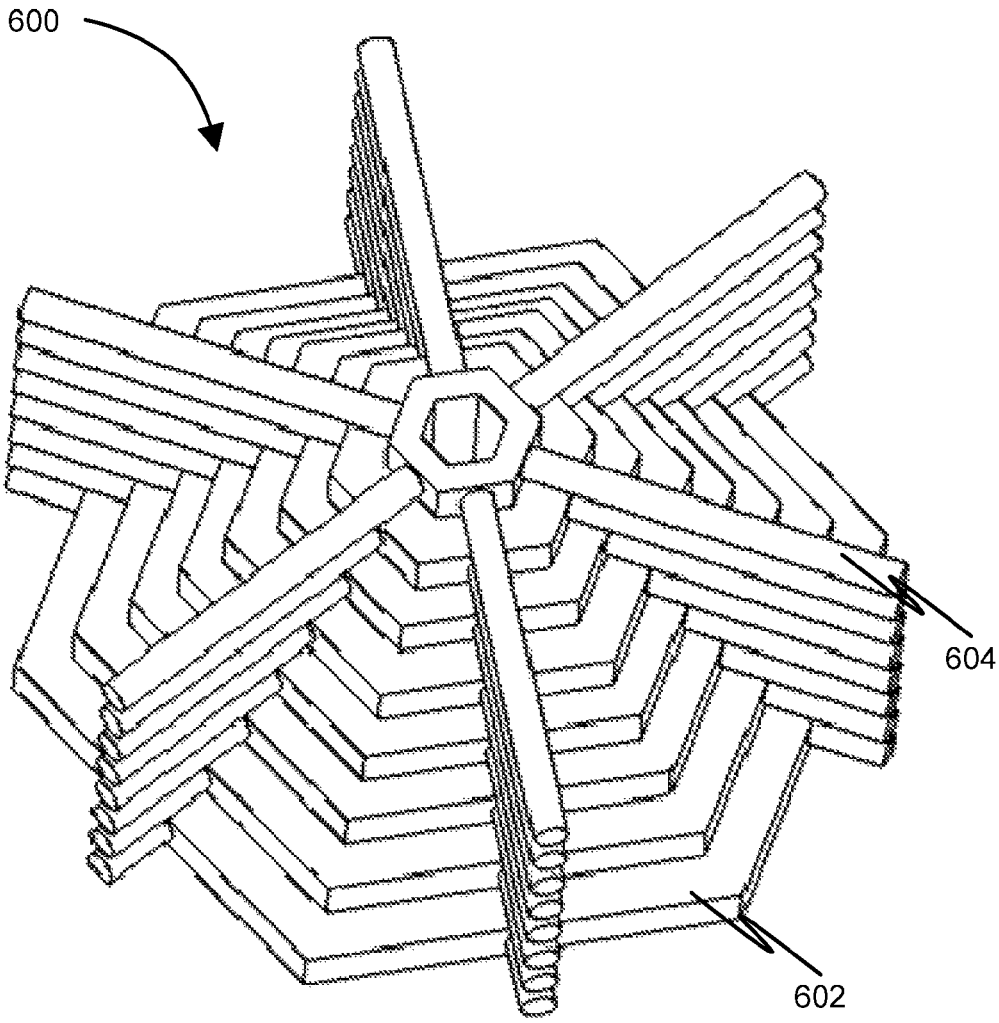
FIG. 6 illustrates a perspective view of an apparatus for plugging one of a leaking oil well and a leaking gas well in accordance with an embodiment.

FIG. 6 illustrates a perspective view of an apparatus 600 for plugging one of a leaking oil well and a leaking gas well in accordance with an exemplary embodiment. Apparatus 600 includes a stepped structure capable of being mounted over one of the leaking oil well and the leaking gas well. The stepped structure includes a plurality of structural modules arranged in a stacked form. Each structural module such as, a structural module 602 of the stepped structure have a hexagonal shape as illustrated in FIG. 6. Further, each structural module includes a plurality of bricks (not shown in FIG. 6). Apparatus 600 further includes a pipe arrangement (not shown in FIG. 6) configured to perpendicularly pass through the plurality of structural modules as described in conjunction with FIG. 1. The pipe arrangement is capable of extracting one or more effluents from one of the leaking oil well and the leaking gas well. Additionally, the one or more effluents may percolate through voids between each brick of the plurality of bricks. The one or more effluents percolated through the voids are retained within the stepped structure. Accordingly, one or more pressure relief pipes such as, a pressure relief pipe 604 are provided for extracting the one or more effluents retained within the stepped structure. The one or more pressure relief pipes protrude outwardly through a peripheral surface of each structural module of the plurality of structural modules in a direction perpendicular to the pipe arrangement. However, it will be apparent to a person skilled in the art that the one or more pressure relief pipes may be configured to protrude outwardly through the peripheral surface at any angle with respect to the pipe arrangement.

Figure 7:
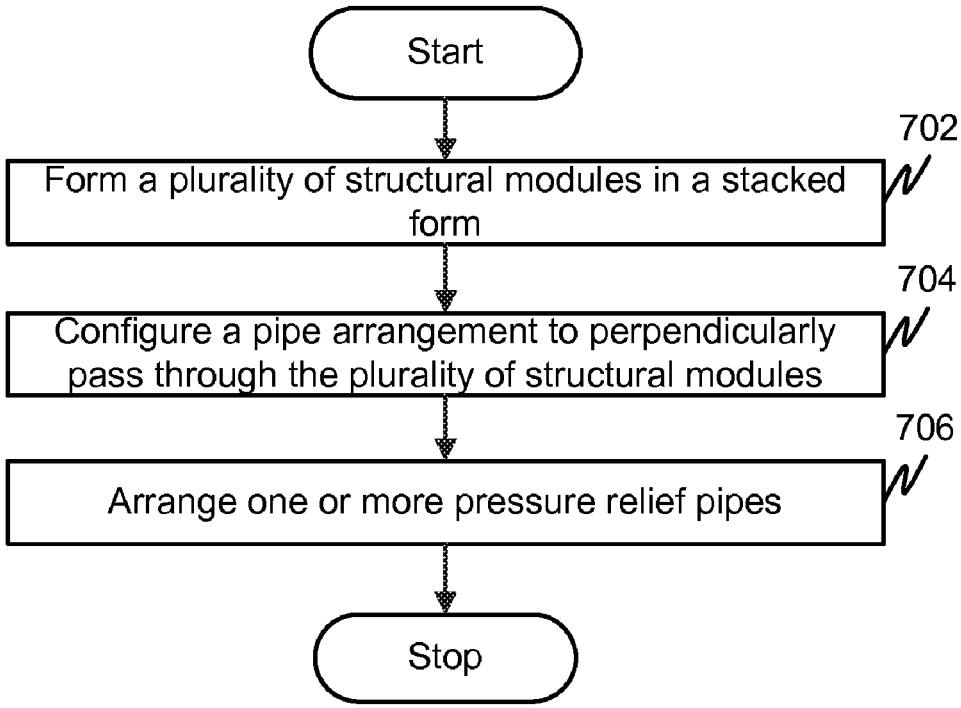
FIG. 7 illustrates a flow diagram for constructing an apparatus for plugging one a leaking oil well and a leaking gas well in accordance with an embodiment.

FIG. 7 illustrates a flow diagram for constructing an apparatus for plugging one a leaking oil well and a leaking gas well in accordance with an embodiment. For example, apparatus 100 have a stepped structure mounted over one of the leaking oil well and the leaking gas well. Accordingly, at step 702, a plurality of structural modules is formed in a stacked form to obtain the stepped structure. Each structural module of the plurality of structural modules includes a plurality of bricks. The plurality of bricks is attached to each other to form each structural module. For example, apparatus 100 includes plurality of structural modules 102-*n*. A plurality of bricks is used for forming each structural module of plurality of structural modules 102-*n*. The weight associated with the plurality of bricks facilitates in firmly positioning apparatus 100 on the leaking oil well and the leaking gas well. The process of constructing the plurality of structural modules is explained in conjunction with FIG. 2. One or more effluents may leak from the leaking oil well and leaking gas well. Accordingly, a pipe arrangement is configured to perpendicularly pass through the plurality of structural modules at step 704. For example, pipe arrangement 106 may pass through plurality of structural modules 102-*n* of apparatus 100 to connect with one of the leaking oil well and the leaking gas well. Thereafter, pipe arrangement 106 extracts the one or more effluents from one of the leaking oil well and the leaking gas well. This is explained in conjunction with FIG. 2, FIG. 3 and FIG. 4.

Subsequently, at step 706, one or more pressure relief pipes are arranged to protrude outwardly through a peripheral surface of each of the plurality of structural modules in a direction away from the pipe arrangement. The peripheral surface may include one or more holes for enabling the one or more pressure relief pipes to pass through the peripheral surface. The one or more pressure relief pipes extract the one or more effluents that flow into plurality of structural modules 102-*n* of apparatus 100. The one or more effluents flow into the voids present in plurality of structural modules 102-*n* in response to an overflow of the one or more effluents from one of the leaking oil well and the leaking well. As the one or more pressure relief pipes extract the one or more effluents, the pressure within apparatus 100 is reduced. This is explained in detail in conjunction with FIG. 2 and FIG. 3.

Figure 8:
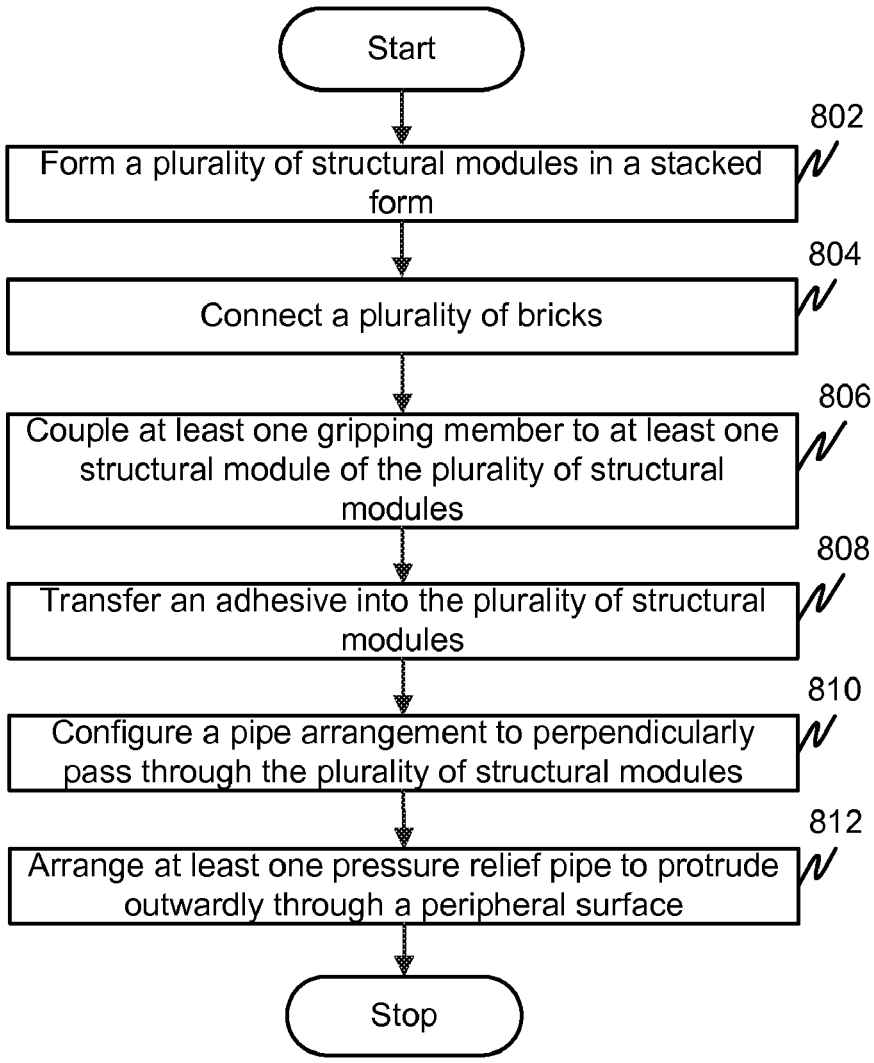
FIG. 8 illustrates a flow diagram for constructing an apparatus for plugging one a leaking oil well and a leaking gas well in accordance with an embodiment.

FIG. 8 illustrates a flow diagram for constructing an apparatus for plugging one a leaking oil well and a leaking gas well in accordance with an embodiment. For example, apparatus 100 having a stepped structure is mounted over one of the leaking oil well and the leaking gas well. Accordingly, at step 802, a plurality of structural modules is formed in a stacked form to obtain the stepped structure. For example, each structural module such as, structural module 102-1 of apparatus 100 includes a plurality of bricks. The plurality of bricks used for forming each structural module of plurality of structural modules 102-*n* facilitates in firmly positioning apparatus 100 on the leaking oil well and the leaking gas well due to the weight of the plurality of bricks. The plurality of bricks are connected to each other using one or more of one or more tapes and one or more steel cables at step 804. For example, the one or more cables may pass through each bricks of the plurality of bricks to connect each brick with another brick. Alternatively, the one or more cables may be wound around a layer of bricks to closely position each brick to another brick in a layer of bricks. This is explained in detail in conjunction with FIG. 2.

Thereafter, at step 806 one or more gripping members are coupled to one or more structural modules of the plurality of structural modules. For example, gripping member 112-1, gripping member 112-2, and gripping member 112-3 may pass through structural module 102-1 of apparatus 100. Structural module 102-1 may include holes for enabling gripping member 112-1, gripping member 112-2 and gripping member 112-3 to pass through structural module 102-1. These gripping members sink into the seabed to enable apparatus 100 to be mounted on one of leaking oil well and the leaking gas well present in the seabed. The one or more gripping members are explained in detail in conjunction with FIG. 1.

Subsequent to forming the plurality of structural modules, an adhesive is transferred into the plurality of structural modules through one or more perforations on each structural module at step 808. The adhesive facilitates in attaching the plurality of structural modules to each other. Subsequent to attaching the plurality of structural modules, a pipe arrangement is perpendicularly passed through the plurality of structural modules at step 810. For example, pipe arrangement 106 is removably coupled to the plurality of structural modules 102-*n* of apparatus 100.

Thereafter, one or more pressure relief pipes are arranged to protrude outwardly through a peripheral surface of each structural module in a direction perpendicular to the pipe arrangement at step 812. For example, pressure relief pipe 110-1 may protrude outwardly from structural module 102-1 of apparatus 100. Pipe arrangement 106 and the one or more pressure relief pipes of apparatus 100 extract one or more effluents released from one of the leaking oil well and the leaking gas well. Subsequently, a flange is removably connected to the pipe arrangement at step 814 for extracting the one or more effluents that pass through the pipe arrangement from one of leaking oil well and the leaking gas well. For example, flange 404 may be connected Various embodiments of the invention provide a method and an apparatus for plugging one of a leaking oil well and a leaking gas well. Pressure caused to due leakage of one or more effluents from an opening of one of the leaking oil well and the leaking gas well is reduced by the stepped structure. Further, a plurality of structural modules provides stability and weight required for efficient plugging of one of the leaking oil well and the leaking gas well.

Those skilled in the art will realize that the above recognized advantages and other advantages described herein are merely exemplary and are not meant to be a complete rendering of all of the advantages of the various embodiments of the present invention.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The present invention is defined solely by the appended claims including any amendments made during the pendency of this application and all equivalents of those claims as issued.

What is claimed is:

1. An apparatus for plugging one of a leaking oil well and a leaking gas well, the apparatus comprising:

a stepped structure capable of being mounted over one of the leaking oil well and the leaking gas well, wherein the stepped structure comprises a plurality of structural modules arranged in a stacked form, wherein the plurality of structural modules are attached to each other using an adhesive;

a pipe arrangement configured to perpendicularly pass through the plurality of structural modules, wherein the pipe arrangement is capable of extracting at least one effluent from one of the leaking oil well and the leaking gas well; and at least one pressure relief pipe protruding outwardly through each of the plurality of structural modules in a direction away from the pipe arrangement, wherein the at least one pressure relief pipe extracts the at least one effluent from one of the leaking oil well and the leaking gas well thereby reducing pressure within the stepped structure.

2. The apparatus of claim 1, wherein each structural module of the plurality of structural modules comprises at least one perforation on a peripheral surface for receiving the adhesive therewithin.

3. The apparatus of claim 1, wherein the plurality of structural modules are removably coupled to each other using at least one fastener.

4. An apparatus for plugging one of a leaking oil well and a leaking gas well, the apparatus comprising:

a stepped structure capable of being mounted over one of the leaking oil well and the leaking gas well, wherein the stepped structure comprises a plurality of structural modules arranged in a stacked form, wherein each structural module of the plurality of structural modules comprises of a plurality of bricks;

a pipe arrangement configured to perpendicularly pass through the plurality of structural modules, wherein the pipe arrangement is capable of extracting at least one effluent from one of the leaking oil well and the leaking gas well; and at least one pressure relief pipe protruding outwardly through each of the plurality of structural modules in a direction away from the pipe arrangement, wherein the at least one pressure relief pipe extracts the at least one effluent from one of the leaking oil well and the leaking gas well thereby reducing pressure within the stepped structure.

5. The apparatus of claim 4, wherein the plurality of bricks are connected to each other using at least one of at least one tape and at least one steel cable.

6. The apparatus of claim 4, wherein a brick of the plurality of bricks is composed of one of metal, cement, and mortar.

7. The apparatus of claim 4, wherein a structural module of the plurality of structural modules perpendicular to the pipe arrangement is one of a triangular shape, a circular shape and a polygonal shape.

8. The apparatus of claim 4, wherein the pipe arrangement comprises:

a repair insert pipe having a first end portion and a second portion, wherein the first end portion of the repair insert pipe is positioned within an opening of one of the leaking oil well and the leaking gas well to extract the at least one effluent;

a flange removably connected to the second end portion of the repair insert pipe.

9. The apparatus of claim 4, wherein a repair insert comprises at least one perforation for collecting the at least one effluent.

10. The apparatus of claim 9, wherein the first end portion of the pipe arrangement has at least one sealing member configured thereon, the at least one sealing member capable of sealing the opening thereby preventing leakage of the at least one effluent.

11. The apparatus of claim 9 further comprising a flange removably connected to one of the pressure relief pipes.

12. The apparatus of claim 4 further comprising at least one gripping member coupled to at least one structural module of the plurality of structural modules, wherein the at least one gripping member enables the stepped structure to be firmly mounted over one of the leaking oil well and the leaking gas well.

13. A method of constructing an apparatus for plugging one of a leaking oil well and a leaking gas well, the method comprising:

forming a plurality of structural modules in a stacked form to obtain a stepped structure, wherein each structural module of the plurality of structural modules comprises of a plurality of bricks;

configuring a pipe arrangement to perpendicularly pass through the plurality of structural modules, wherein the pipe arrangement is removably coupled to the plurality of structural modules; and arranging at least one pressure relief pipe to protrude outwardly through each of the plurality of structural modules in a direction away from the pipe arrangement.

14. The method of claim 13 further comprising coupling at least one gripping member to at least one structural module of the plurality of structural modules, wherein the at least one gripping member is capable of firmly mounting the plurality of structural modules over one of the leaking oil well and the leaking gas well.

15. The method of claim 13 further comprising transferring an adhesive into the plurality of structural modules through at least one perforation on each structural module, wherein the adhesive facilitates in attaching the plurality of structural modules to each other.

16. The method of claim 13 further comprising connecting the plurality of bricks using at least one of at least one tape and at least one steel cable.

* * * * *